US011605313B2

(12) United States Patent
Shurtliffe et al.

(10) Patent No.: US 11,605,313 B2
(45) Date of Patent: Mar. 14, 2023

(54) LABEL SHEET ASSEMBLY WITH PUNCTURE SURFACE FEATURES

(71) Applicant: CCL Label, Inc., Framingham, MA (US)

(72) Inventors: Laura Shurtliffe, Whitby (CA); Angelo Capobianco, Whitby (CA)

(73) Assignee: CCL Label, Inc., Framingham, MA (US)

( * ) Notice: Subject to any disclaimer, the term of this patent is extended or adjusted under 35 U.S.C. 154(b) by 0 days.

(21) Appl. No.: 17/234,975

(22) Filed: Apr. 20, 2021

(65) Prior Publication Data

US 2022/0005382 A1 Jan. 6, 2022

Related U.S. Application Data

(60) Provisional application No. 63/047,357, filed on Jul. 2, 2020.

(51) Int. Cl.
*G09F 3/10* (2006.01)
*G09F 3/02* (2006.01)

(52) U.S. Cl.
CPC ..... *G09F 3/10* (2013.01); *G09F 3/02* (2013.01); *G09F 2003/0201* (2013.01); (Continued)

(58) Field of Classification Search
CPC ..... G09F 3/10; G09F 3/02; G09F 2003/0201; G09F 2003/0202; G09F 2003/0269; Y10T 428/14
See application file for complete search history.

(56) References Cited

U.S. PATENT DOCUMENTS

D2,856 S 12/1867 Stafford
D17,746 S 9/1887 Mellinger
(Continued)

FOREIGN PATENT DOCUMENTS

AU 8832691 6/1992
CA 2134400 5/1995
(Continued)

OTHER PUBLICATIONS

International Search Report and the Written Opinion of the International Searching Authority, PCT/US14/18869, CCL Label, Inc., May 30, 2014.
(Continued)

*Primary Examiner* — Patricia L. Nordmeyer
(74) *Attorney, Agent, or Firm* — McDonald Hopkins LLC

(57) ABSTRACT

A label sheet assembly is disclosed for improving the process of feeding label sheets through a printer. The label sheet includes a facestock layer and a liner sheet. The facestock layer includes an adhesive layer along a first side and include a label surface along a second side opposite the adhesive layer. The label sheet may include a puncture surface feature along a matrix portion of the facestock layer, wherein the puncture surface feature may include a plurality of puncture holes formed in a shape wherein each puncture hole that forms a slightly concave shape along one side and a slightly convex shape along the opposite side. The puncture surface features provides a zone of tactile sensitivity along the label sheet and are configured to reduce off-registration of printed indicia along the at least one label when processed through a printer device.

20 Claims, 10 Drawing Sheets

(52) U.S. Cl.
CPC ..... *G09F 2003/0202* (2013.01); *G09F 2003/0269* (2013.01); *Y10T 428/14* (2015.01)

(56) References Cited

U.S. PATENT DOCUMENTS

D79,566 S 10/1929 Rau
D120,517 S 3/1940 Steffen
2,276,297 A 3/1942 Flood
2,303,346 A 12/1942 Flood
2,304,787 A 12/1942 Avery
2,321,184 A 6/1943 Butterworth
2,331,019 A 10/1943 Flood
2,372,994 A 4/1945 Welch
2,420,045 A 5/1947 Krug
2,434,545 A 1/1948 Brady, Jr. et al.
D168,758 S 2/1953 Ddzer
2,679,928 A 6/1954 Bishop, Jr. et al.
2,681,732 A 6/1954 Brady
2,765,205 A 10/1956 Capella et al.
2,883,044 A 4/1959 Kendrick
D189,472 S 12/1960 Currie et al.
D190,360 S 5/1961 Cohen et al.
3,038,597 A 6/1962 Brady, Jr.
3,140,215 A 7/1964 Russell
3,166,186 A 1/1965 Kam
3,228,710 A 1/1966 Chodorowski
3,230,649 A 1/1966 Kam
3,315,387 A 4/1967 Heuser
3,361,252 A 1/1968 Wise
3,380,871 A 4/1968 Thomas
3,480,198 A 11/1969 Repko
3,568,829 A 3/1971 Brady, Jr.
3,769,147 A 10/1973 Komendat et al.
3,822,492 A 7/1974 Crawley
3,825,463 A 7/1974 Amann
3,854,229 A 12/1974 Morgan
3,859,157 A 1/1975 Morgan
3,896,246 A 7/1975 Brady
3,914,483 A 10/1975 Stipek, Jr.
3,965,327 A 6/1976 Ehlscheid et al.
4,032,679 A 6/1977 Aoyagi
4,051,285 A 9/1977 Kramer
4,060,168 A 11/1977 Romagnoli
4,061,808 A 12/1977 Sato
4,128,954 A 12/1978 White
4,188,251 A 2/1980 Grass
4,217,164 A * 8/1980 La Mers ..... G09F 3/10 156/DIG. 33
4,243,458 A 1/1981 Giulie
4,264,662 A 4/1981 Taylor
4,356,375 A 10/1982 Josephy et al.
4,380,564 A 4/1983 Cancio
4,398,287 A 8/1983 Spencer
4,398,985 A 8/1983 Eagon
4,428,857 A 1/1984 Taylor
4,446,183 A 5/1984 Savagian
4,454,180 A * 6/1984 La Mers ..... B65C 9/36 156/252
4,459,344 A 7/1984 Jacob
4,465,729 A 8/1984 Cancio
4,524,095 A 6/1985 Gockel et al.
4,528,054 A 7/1985 Stahl
4,537,809 A 8/1985 Ang et al.
4,545,517 A 10/1985 Olson
4,547,252 A * 10/1985 LaMers ..... B65C 9/36 156/542
4,548,845 A 10/1985 Parsons
4,560,600 A 12/1985 Yellin et al.
4,599,125 A 7/1986 Buck
4,619,851 A 10/1986 Sasaki et al.
4,637,635 A 1/1987 Levine
4,648,930 A 3/1987 La Mers
4,704,317 A 11/1987 Hickenbotham
4,706,877 A 11/1987 Jenkins
4,771,891 A 9/1988 Sorensen et al.
4,787,158 A 11/1988 Vitol
4,799,712 A 1/1989 Biava et al.
D300,692 S 4/1989 Le Brocquy
4,833,122 A 5/1989 Doll
4,837,088 A 6/1989 Freedman
4,846,504 A 7/1989 MacGregor et al.
4,850,612 A 7/1989 Instance
4,865,204 A 9/1989 Vance
4,878,643 A 11/1989 Stinson
4,879,148 A 11/1989 Neaves et al.
4,881,935 A 11/1989 Slobodkin
4,881,936 A 11/1989 Slobodkin
4,882,211 A 11/1989 McIntyre et al.
4,890,862 A 1/1990 Buchholz
D306,321 S 2/1990 Gramera
4,910,058 A 3/1990 Jameson
4,951,970 A 8/1990 Burt
4,952,433 A 8/1990 Tezuka
4,978,146 A 12/1990 Warther et al.
5,007,191 A 4/1991 Klein
5,031,939 A 7/1991 Webendorfer et al.
5,011,559 A 8/1991 Felix
5,090,733 A 2/1992 Bussiere
5,091,035 A 2/1992 Anhaeuser
5,100,728 A 3/1992 Plamthbottam et al.
5,123,762 A * 6/1992 McCartney ..... B41J 11/34 400/616
5,129,682 A 7/1992 Ashby
5,182,152 A 1/1993 Ericson
5,192,612 A 3/1993 Otter
5,209,810 A 5/1993 Marschke
5,230,938 A 7/1993 Hess
5,238,269 A 8/1993 Levine
5,262,216 A 11/1993 Popat
5,284,689 A 2/1994 Laurash
5,288,714 A 2/1994 Marschke
5,318,325 A 6/1994 Ipsen
5,324,153 A 6/1994 Chess
5,328,538 A 7/1994 Garrison
5,332,265 A 7/1994 Groess et al.
5,346,766 A 9/1994 Otter
5,389,414 A 2/1995 Popat
5,403,236 A 4/1995 Greig
5,407,718 A 4/1995 Popat
5,413,532 A 5/1995 Raby
5,416,134 A 5/1995 Skoglund
5,462,783 A 10/1995 Esselman
5,484,168 A 1/1996 Chigot
5,487,929 A 1/1996 Rusincovitch
5,495,981 A 3/1996 Warther
5,509,693 A 4/1996 Kohls
5,509,694 A 4/1996 Laurash et al.
5,512,343 A 4/1996 Shaw
5,518,787 A 5/1996 Konkol
5,520,990 A 5/1996 Rotermund
5,530,793 A 6/1996 Watkins
5,534,320 A 7/1996 Raby
5,536,546 A 7/1996 Nash
5,558,454 A 9/1996 Owen
5,599,128 A 2/1997 Steiner
5,601,314 A 2/1997 Burns et al.
5,625,996 A 5/1997 Bechtel
5,627,578 A 5/1997 Weintraub
5,632,511 A 5/1997 Longtin
5,633,071 A 5/1997 Murphy
5,658,631 A 8/1997 Bernstein
5,662,976 A 9/1997 Popat
5,670,225 A 9/1997 Yoshizawa
5,686,159 A 11/1997 Langan
5,700,535 A 12/1997 Galsterer et al.
5,720,499 A 2/1998 Sakashita
5,730,826 A 3/1998 Sieber
5,735,453 A 4/1998 Glok et al.
5,756,175 A 5/1998 Washburn
5,769,457 A 6/1998 Warther
5,782,494 A 7/1998 Crandall et al.
5,782,497 A 7/1998 Casagrande
5,788,284 A 8/1998 Hirst
5,789,050 A 8/1998 Kang

(56) References Cited

U.S. PATENT DOCUMENTS 5,825,996 A 10/1998 Davis
5,836,622 A * 11/1998 Fabel ..... B42D 15/02 229/92.8
5,842,722 A 12/1998 Carlson
5,853,837 A 12/1998 Popat
5,866,249 A 2/1999 Yarusso
5,947,525 A 9/1999 Pollman
5,958,536 A 9/1999 Geisinger et al.
5,993,928 A 10/1999 Popat
5,981,013 A 11/1999 Russ et al.
5,997,680 A 12/1999 Popat
6,001,209 A 12/1999 Popat
6,004,643 A 12/1999 Scheggelman
6,033,751 A 3/2000 Kline
6,110,552 A 8/2000 Casey et al.
6,126,773 A 10/2000 Fernandez-Kirchenberger
6,132,829 A 10/2000 Kennerly
6,135,504 A 10/2000 Teng
6,136,130 A 10/2000 Tataryan
6,149,518 A 11/2000 Farrow
6,159,570 A 12/2000 Ulrich
6,170,879 B1 1/2001 Rawlings
6,221,192 B1 4/2001 Walsh
6,256,109 B1 7/2001 Rosenbaum
6,277,229 B1 8/2001 Popat
6,277,456 B1 8/2001 Bulgrin
D448,404 S 9/2001 Hamilton et al.
6,284,708 B1 9/2001 Oshima et al.
6,331,018 B1 12/2001 Roth et al.
6,340,512 B1 1/2002 Mercer
6,352,287 B2 3/2002 Casagrande
6,352,608 B1 3/2002 Garden
6,361,078 B1 3/2002 Chess
6,363,987 B1 4/2002 Koch
6,364,364 B1 4/2002 Murphy
6,379,760 B1 4/2002 Tang
6,391,136 B1 5/2002 Stickelbrocks
6,403,184 B1 6/2002 Michlin
6,405,777 B1 6/2002 Lebbad
6,408,918 B1 6/2002 Hummell et al.
6,410,111 B1 6/2002 Roth
6,413,604 B1 7/2002 Matthews et al.
6,431,238 B1 8/2002 Atkinson
6,479,118 B1 11/2002 Atkinson
6,482,490 B1 11/2002 Hanahara et al.
6,517,921 B2 2/2003 Ulrich
6,521,312 B1 2/2003 Keiser
D471,933 S 3/2003 Hodson et al.
D476,031 S 6/2003 Hodsdon et al.
6,579,585 B1 6/2003 Garvic
D482,073 S 11/2003 Nakajo et al.
6,656,555 B1 12/2003 McKillip
6,803,084 B1 10/2004 Do
6,837,955 B1 1/2005 McCarthy
6,837,957 B2 1/2005 Flynn
6,860,050 B2 3/2005 Flynn
6,861,116 B2 3/2005 Emmert
6,890,397 B1 5/2005 Weirather
6,905,747 B2 6/2005 Auchter
6,926,942 B2 8/2005 Garvic
6,955,843 B2 10/2005 Flynn et al.
7,144,469 B2 12/2006 McCarthy
7,246,823 B2 7/2007 Laurash et al.
7,265,871 B2 9/2007 Ishii
7,288,163 B2 10/2007 Weirather
7,374,631 B1 5/2008 Weirather
7,377,996 B2 5/2008 Bilodeau
7,438,322 B2 10/2008 Miller
7,459,193 B2 12/2008 Utz
7,579,076 B2 8/2009 Ishikawa
7,627,972 B2 12/2009 Hodsdon et al.
7,641,951 B2 1/2010 Hodsdon et al.
7,652,619 B1 1/2010 Hibbard et al.
7,709,071 B2 5/2010 Wong et al.
7,963,564 B2 6/2011 Flynn et al.
7,967,340 B2 6/2011 Hofer et al.
D645,504 S * 9/2011 Liu ..... D19/1
D702,287 S 4/2014 Kott
D716,374 S 10/2014 Osmanovski et al.
8,870,367 B2 10/2014 Delmerico
D813,945 S * 3/2018 Li ..... D19/2
D841,087 S * 2/2019 Jameson ..... D19/1
D856,414 S * 8/2019 Jameson ..... D19/1
D879,875 S * 3/2020 Li ..... D19/1
10,636,329 B2 * 4/2020 Li ..... B32B 7/12
D900,926 S * 11/2020 Jameson ..... D19/1
11,049,420 B2 * 6/2021 Utz ..... G09F 3/10
D930,073 S * 9/2021 Li ..... D19/1
2002/0011306 A1 1/2002 Hannington
2002/0086127 A1 7/2002 Hodsdon et al.
2003/0133098 A1 7/2003 Hoshino et al.
2004/0078468 A1 4/2004 Hedin et al.
2004/0101646 A1 5/2004 Hodsdon et al.
2005/0087977 A1 4/2005 Crum
2005/0175807 A1 8/2005 Bilodeau
2005/0238836 A1 10/2005 Hodsdon
2006/0028015 A1 2/2006 Ray
2006/0049625 A1 3/2006 Miller
2006/0125230 A1 6/2006 Laurash et al.
2006/0147668 A1 7/2006 Hirose et al.
2006/0154012 A1 7/2006 Ashton
2007/0275204 A1 11/2007 Ugolick
2008/0054622 A1 3/2008 Hodson et al.
2008/0061548 A1 3/2008 Kurunda et al.
2008/0163973 A1 7/2008 Euse
2009/0022926 A1 1/2009 Dangami
2009/0246427 A1 10/2009 Hincks et al.
2010/0080946 A1 4/2010 Hodsdon et al.
2010/0116425 A1 5/2010 Konsti et al.
2010/0233412 A1 9/2010 Wong et al.
2014/0106132 A1 * 4/2014 Hong ..... B41M 5/00 428/177
2017/0116890 A1 * 4/2017 Li ..... B32B 3/266
2018/0137787 A1 * 5/2018 Utz ..... G09F 3/10

FOREIGN PATENT DOCUMENTS

CA 2409986 11/2001
CN 1282441 1/2001
DE 1296363 5/1969
DE 2257435 6/1973
DE 4003129 8/1990
DE 19519584 12/1996
DE 19741563 3/1998
DE 19724648 12/1998
DE 19945254 8/2001
DE 69909841 5/2004
DE 202004011509 9/2004
EP 0044889 2/1982
EP 0297705 1/1989
EP 0389112 9/1990
EP 0418608 3/1991
EP 0488813 6/1992
EP 0765514 4/1997
EP 1319601 6/2003
EP 1382458 1/2004
EP 1551621 7/2005
FR 1568013 5/1969
FR 1586336 1/1970
FR 2634931 2/1985
FR 2706214 12/1994
FR 2724479 3/1996
GB 2143204 2/1985
GB 2177373 1/1987
GB 2179910 3/1987
JP 07199503 8/1995
JP 2000109762 4/2000
JP 2000326944 11/2000
JP 2001101827 4/2001
JP 2003150058 5/2003
JP 2005128458 5/2005
JP 2004569155 4/2006
JP 4029353 10/2007
JP 2008058450 3/2008

(56) References Cited

FOREIGN PATENT DOCUMENTS

| | | |
|---|---|---|
| JP | 2013074100 | 4/2013 |
| WO | 9219457 | 11/1992 |
| WO | 9534879 | 12/1995 |
| WO | 9847771 | 10/1998 |
| WO | 0189821 | 11/2001 |
| WO | 2002038371 | 5/2002 |
| WO | 2003020597 | 3/2003 |
| WO | 2004078468 | 9/2004 |

OTHER PUBLICATIONS

International Preliminary Examination Report dated Mar. 29, 2003 from corresponding International Application No. PCT/US01/42357.
Supplemental Search Report dated Mar. 30, 2007 from corresponding European Application No. 01977837.2.
International Preliminary Report on Patentability dated Aug. 2, 2005 from International Application No. PCT/EP04/006324 filed Jun. 11, 2004.
International Search Report dated Feb. 16, 2005 from International Application No. CT/EP04/006324 filed Jun. 11, 2004.
Supplemental European Search Report dated Oct. 4, 2007 from European Application No. 03713742.9.
European Patent Office, International Search Report and Written Opinion for PCT/US09/041586, dated Dec. 4, 2009.
Patent Cooperation Treaty (PCT), International Search Report and Written Opinion for Application No. PCT/US2016/058180 filed Oct. 21, 2016, dated Jan. 3, 2017, European Patent Office, Netherlands.
Written Opinion dated Feb. 14, 2005 from International Application No. PCT/EP/04/006324 filed Jun. 11, 2004.

* cited by examiner

LABEL SHEET ASSEMBLY WITH PUNCTURE SURFACE FEATURES

CROSS-REFERENCES TO RELATED APPLICATIONS

This application claims priority to and the benefit of U.S. Provisional Patent application No. 63/047,357, titled "LABEL SHEET ASSEMBLY WITH PUNCTURE SURFACE FEATURES," filed on Jul. 2, 2020. The present application is also related to U.S. patent application Ser. No. 15/813,693, titled "LABEL SHEET ASSEMBLY WITH SURFACE FEATURES," filed on Nov. 17, 2017, which claims the benefit of U.S. Provisional Application No. 62/422,364, titled "LABEL SHEET FEED EDGE ASSEMBLY," filed on Nov. 15, 2016, and U.S. Provisional Application No. 62/475,288, titled "LABEL SHEET ASSEMBLY WITH SURFACE FEATURES," filed on Mar. 23, 2017 which are hereby incorporated by reference in their entirety.

FIELD OF INVENTION

The present disclosure generally relates to a label sheet assembly and method of making a label sheet assembly that is configured to be processed through a printer to print indicia thereon. More particularly, the disclosure relates to a label sheet assembly with patterns of puncture surface features that is configured to improve printer processing.

BACKGROUND

Labels and label sheets are well known, and various types have been proposed to meet the requirements of a wide variety of label applications. For example, labels are extensively used in retail businesses for communicating product information to customers. Labels generally include a facestock layer with an adhesive side and an exposed side. The exposed side includes a surface for receiving label indicia thereon and is opposite from the adhesive side. A liner sheet is operably attached to the adhesive side and is configured to allow a user to peel the label portion of the facestock from the liner sheet to be placed on a substrate. A plurality of cut lines may separate the facestock layer into a plurality of labels in various arrangements.

Many label sheets are configured to be fed through a printer to print ink on the surface of the labels. For example, U.S. Pat. No. 7,709,071 to Wong et al. discloses a particular type of label sheet assembly that is configured to be fed through a printer, and also allows a user to easily remove labels by hand. This patent is incorporated herein by reference in its entirety. These label sheet assemblies allow a user broad discretion as to the orientation of the label and the indicia to be printed thereon. However, problems arise when a user processes label sheets through a printer, such as an inkjet printer, desktop printer, or laser printer. Many printers are configured to receive a label sheet or other sheet and process it through at least one, but usually more than one, rotary mechanism during the printing process. These processes may cause portions of the label sheet assembly to become creased, manipulated or otherwise disengaged. This may cause ink to shift or labels to be moved relative the remaining facestock layer or liner sheet. This off-registration may be due, in part, to the level of friction between a leading edge of the label sheet and the receiving area of the printer device. Labels risk damage and indicia may not be accurately printed along the labels.

Therefore, there is a need for a label sheet assembly having a facestock and liner material that can be configured to reduce inconsistent processing through a printer. There is also a need for an improved method of feeding a label sheet through a printer to accurately apply ink or indicia thereon without unduly manipulating the orientation of the labels or label sheet assembly.

SUMMARY

The present system leverages the advantages of a label sheet assembly with a plurality of puncture surface features arranged in a pattern. Provided are embodiments of a label sheet assembly that include a facestock layer having first and second sides, the facestock layer including at least one cut line that defines at least one label on the first side wherein the facestock layer is configured to receive indicia thereon. Additionally, a matrix portion, or portion not intended to receive indicia thereon, may be included in the facestock layer. An adhesive layer is provided along the second side and a liner sheet layer having top and bottom surfaces, the top surface attached to the adhesive layer along the facestock layer. At least one puncture surface feature is provided along a header portion or a footer portion of the label sheet assembly, wherein the at least one puncture surface feature may provide a zone of increased tactile sensitivity along the label sheet assembly. Further, the puncture surface feature may also provide a zone of increased friction thereon.

A first puncture surface feature may be applied along a header portion and may include a plurality of holes that extend through the facestock layer and the liner sheet layer in a desired pattern. A second puncture surface feature may be applied along a footer portion and may include a plurality of holes that extend through the facestock layer and the liner sheet layer. The at least one puncture surface feature may be configured in the form of a shape such as a triangle, octagon, square, arrow, star, rectangle, or any other shape. Also, the puncture surface feature may include a plurality of holes arranged in a pattern of letters or numbers. Further, the pattern of the puncture surface feature may be outlined with indicia along the header portion and the footer portion. Such indicia may include a border, pattern, color, image, or font that is arranged with the pattern of the plurality of puncture surface features. The puncture surface features may include a patterned solid color with contrasting indicia located along the header or footer portions.

Specific reference is made to the appended claims, drawings, and description below, all of which disclose elements of the disclosure. While specific embodiments are identified, it will be understood that elements from one described aspect may be combined with those from a separately identified aspect, as combinations of the described features can be exchanged and/or replaced with the other disclosed features herein. In the same manner, a person of ordinary skill will have the requisite understanding of common processes, components, and methods, and this description is intended to encompass and disclose such common aspects even if they are not expressly identified herein.

BRIEF DESCRIPTION OF THE DRAWINGS

Operation of the disclosure may be better understood by reference to the following detailed description taken in connection with the following illustrations, wherein.

DETAILED DESCRIPTION

Reference will now be made in detail to embodiments of the present disclosure, examples of which are illustrated in the accompanying drawings. It is to be understood that other embodiments may be utilized and structural and functional changes may be made without departing from the respective scope of the disclosure. Moreover, features of the various embodiments may be combined or altered without departing from the scope of the disclosure. As such, the following description is presented by way of illustration only and should not limit in any way the various alternatives and modifications that may be made to the illustrated embodiments and still be within the spirit and scope of the disclosure.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

A label sheet assembly 10 is disclosed and may be of any appropriate configuration and is not limited to that shown and described herein. It should similarly be understood that the sheet assembly 10 may be adapted to any appropriate size, including, without limitation, 8.5 inches by 11 inches, A4 size, legal size or any other size, including, without limitation smaller sizes. The sheet assembly 10 may be made of any appropriate materials and colors or indicia and this disclosure is not limited in this regard.

Figure 1:
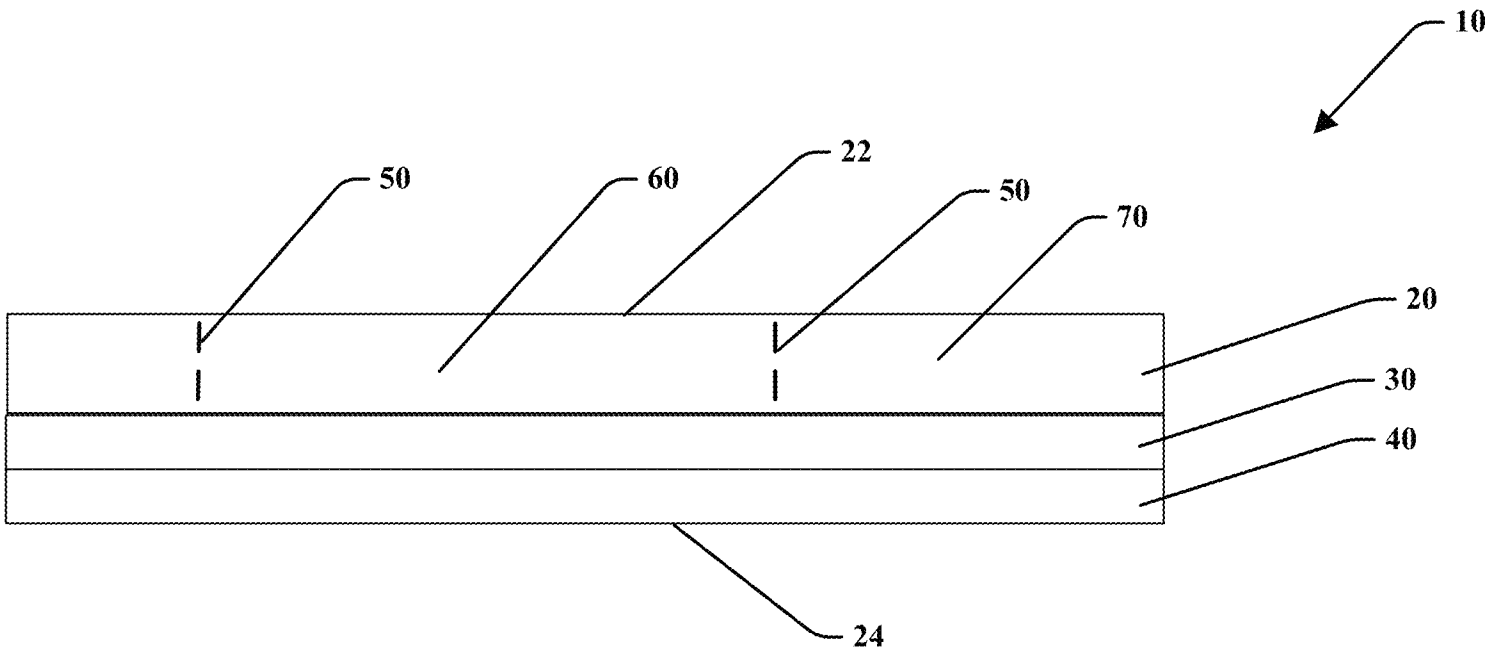
FIG. 1 is a cross sectional view of an embodiment of a label sheet assembly of the present disclosure.

FIG. 1 is a cross sectional side view of the sheet assembly 10 that may include a facestock layer 20 that may be coated with a pressure sensitive adhesive layer 30. The sheet assembly 10 may also include a liner sheet 40 attached to the adhesive layer 30. The liner sheet 40 may include a release coating for supporting the adhesive layer 30. The liner sheet 40 may be made of any appropriate material, including, without limitation a calendared paper or polymer film. The facestock layer 20 may be of any appropriate material, including, without limitation a paper, plastic or polymer material such as a polyester material or other transparent, translucent or semi-translucent material. The facestock layer 20 may also be a laminate or a label or combination of both. The facestock layer may have a top surface 22 that is configured to receive indicia thereon.

Figure 2:
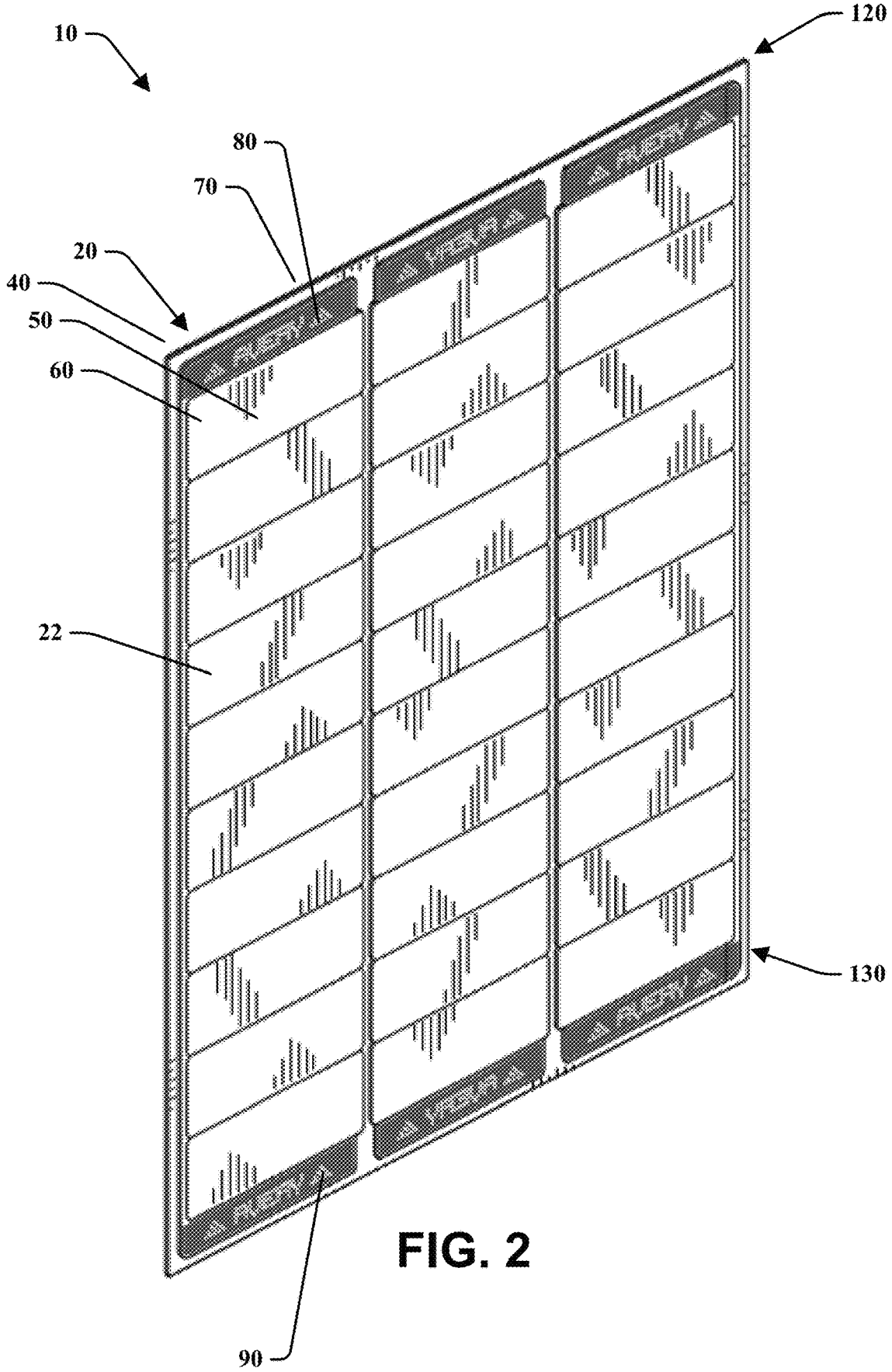
FIG. 2 is a perspective view of an embodiment of a label sheet assembly of the present disclosure with a plurality of puncture surface features.
Figure 3:
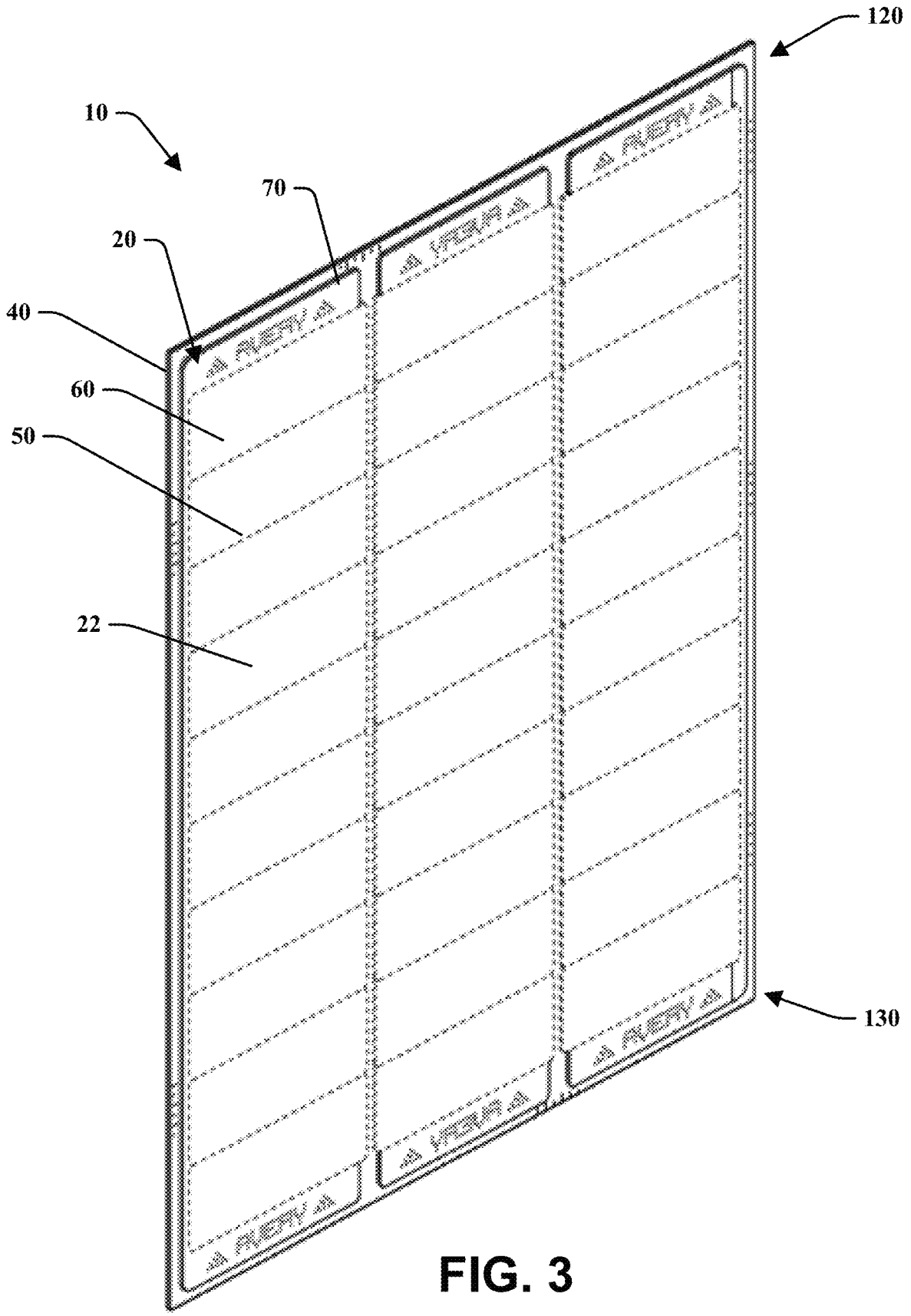
FIG. 3 is a perspective view of an embodiment of a label sheet assembly of the present disclosure with a plurality of puncture surface features.

As illustrated by FIGS. 2 and 3, the top surface 22 of facestock layer 20 in embodiments of the sheet assembly 10 are shown in a perspective view. The sheet assembly 10 may include at least one cut line 50 that may extend through the facestock layer 20 to separate the sheet assembly into at least one label 60 and a matrix portion 70. In this embodiment, the facestock layer 20 includes thirty (30) labels 60 having a generally rectangular shape with rounded corners, wherein ten labels are aligned in each of three rows. However, this application is not limited as to the configuration, amount, or size of the labels 60. The present labels 60 are disclosed for the sake of brevity, but the teachings herein apply to any number of labels, in any number of columns, and any size and shape of labels.

Figure 4:
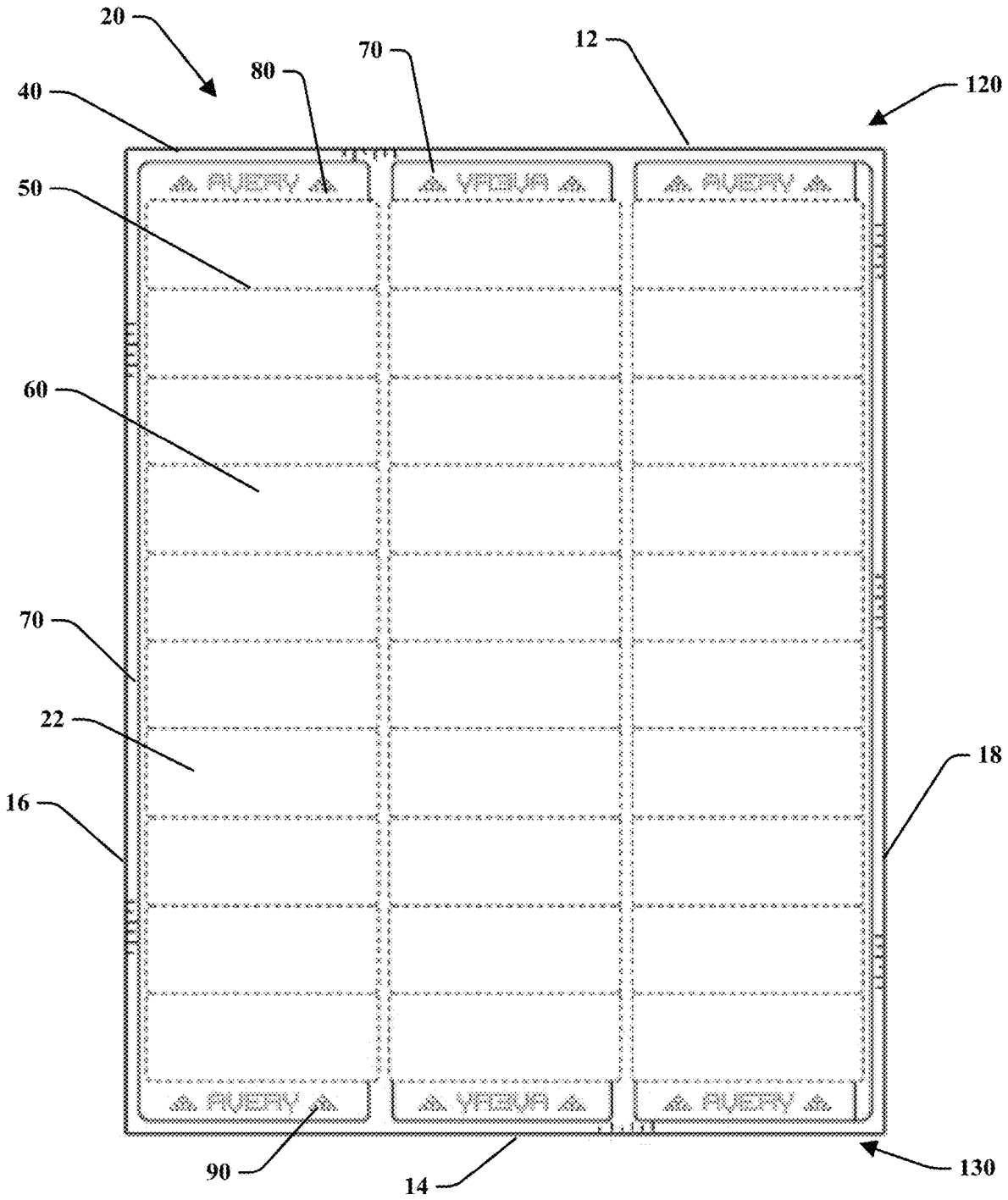
FIG. 4 is a plan view of an embodiment of the label sheet assembly of the present disclosure with a plurality of puncture surface features.
Figure 5:
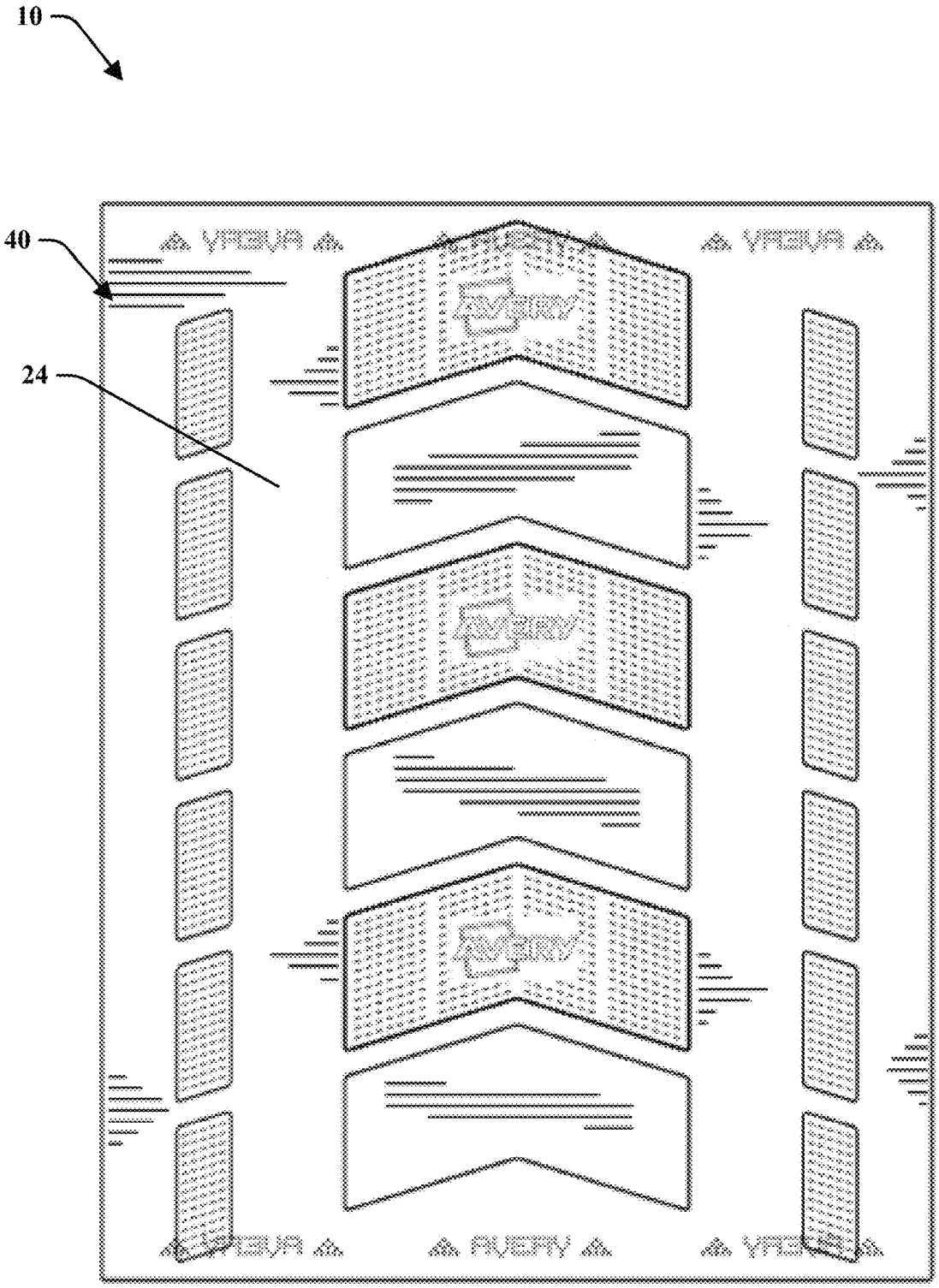
FIG. 5 is a back view of an embodiment of the label sheet assembly of the present disclosure with a plurality of puncture surface features.
Figure 6:
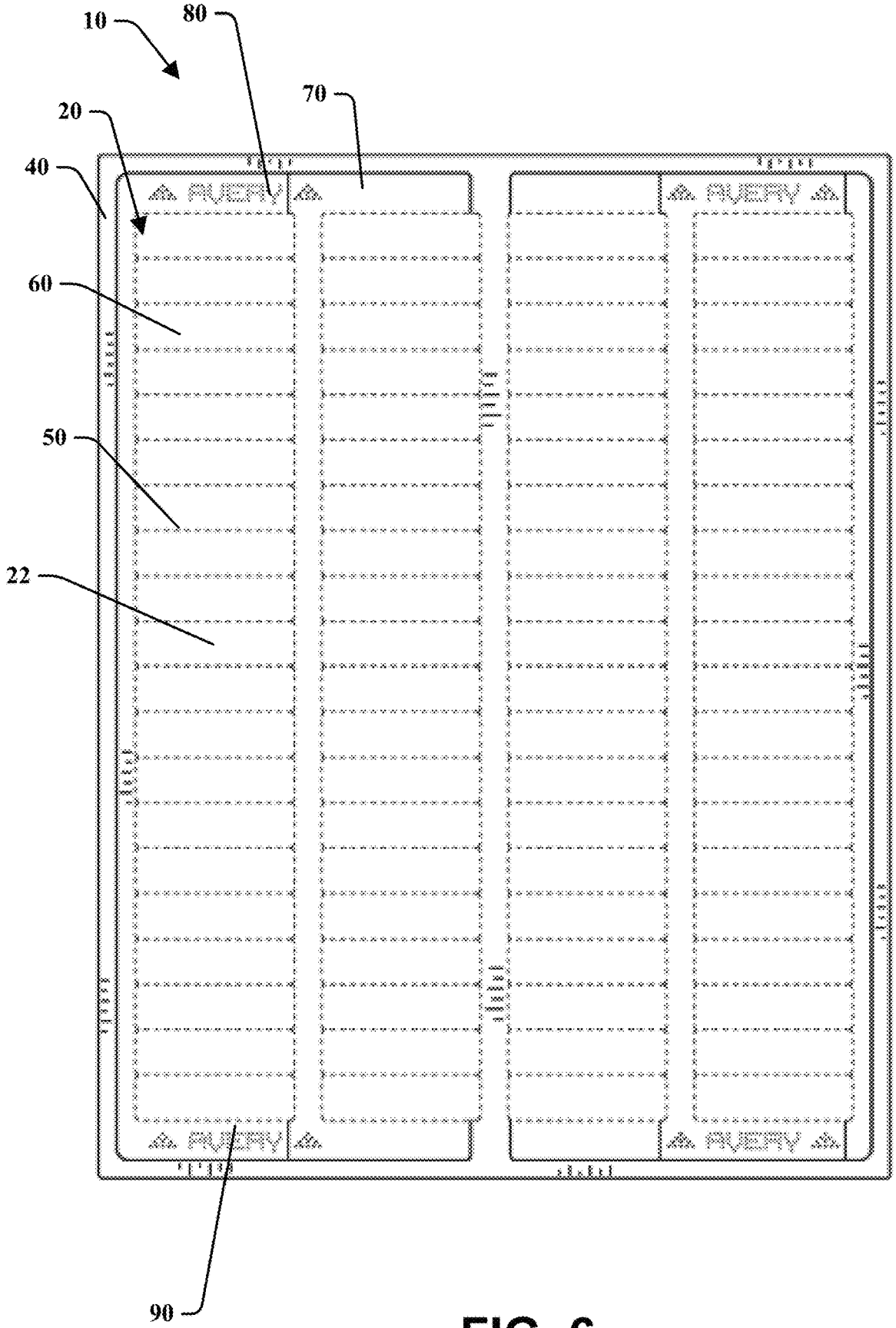
FIG. 6 is a plan view of an embodiment of the label sheet assembly of the present disclosure with a plurality of puncture surface features.
Figure 7:
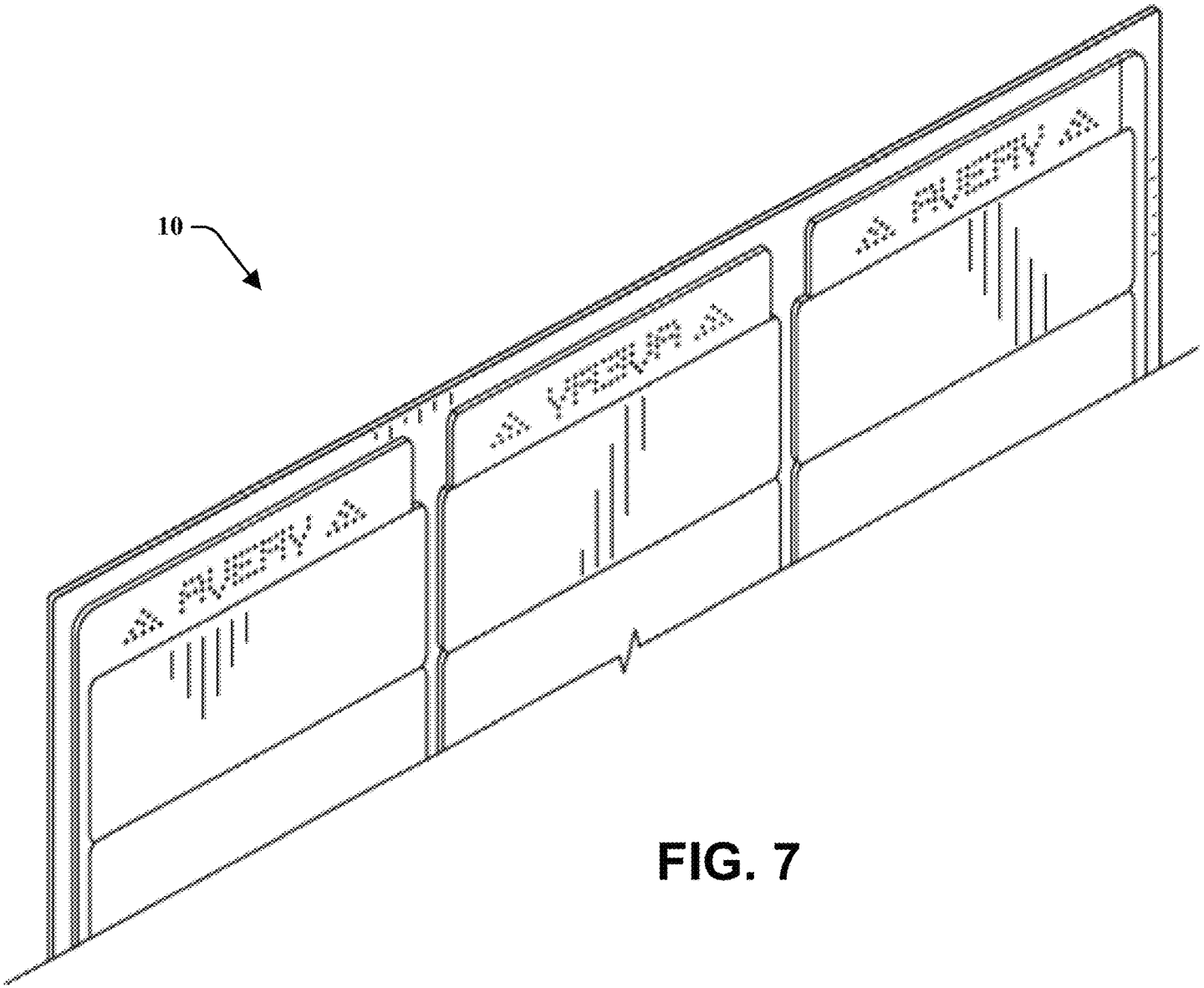
FIG. 7 is an enlarged perspective view of an embodiment of the label sheet assembly of FIG. 3.
Figure 8:
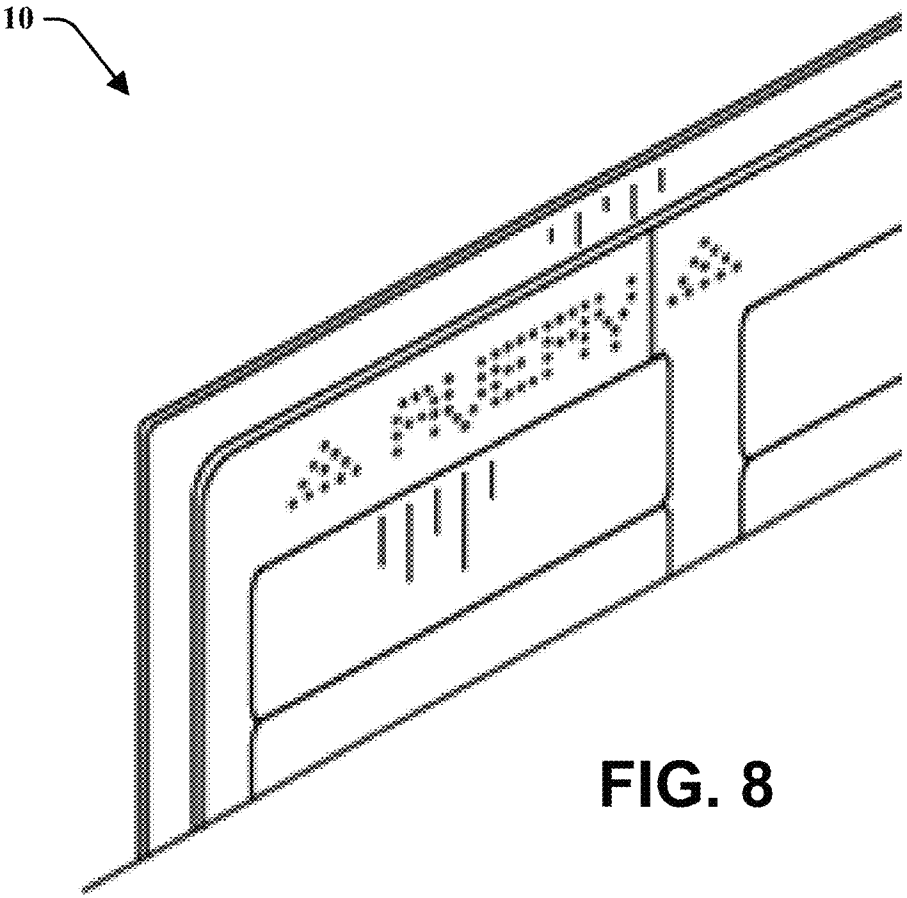
FIG. 8 is an enlarged perspective view of another embodiment of the label sheet assembly in accordance with an embodiment of the present disclosure.

Turning to FIG. 4, the label sheet assembly 10 may include a first edge 12 and opposite second edge 14, along with a third edge 16 and opposite fourth edge 18. These edges 12, 14, 16, 18 may intersect to form a generally rectangular sheet assembly, wherein the label sheet assembly 10 may be configured to be fed into a conventional printer device or conventional scanner device (such as, by way of a non-limiting example, an ink jet and/or laser printer) from any edge.

The label sheet assembly 10 may include various surface features in different arrangements and be made from various materials, as disclosed in related U.S. patent application Ser. No. 15/813,693. In one embodiment, the surface feature is a plurality of first puncture surface features 80 that may be positioned along the matrix portion 70 of the facestock layer 20. The puncture surface features 80 may be placed along and adjacent to the first edge 12 between the third edge 16 and the fourth edge 18 as illustrated. This location may be referred to as the header portion 120. Further, there may be a plurality of puncture surface features 90 that may be positioned along the matrix portion 70 along an opposite side of the label sheet assembly 10 as the first plurality of puncture surface features 80. These puncture surface features 90 may be placed along and adjacent to the second edge 14 and extend between the third edge 16 and the fourth edge 18. This location may be referred to as the footer portion 130. In this embodiment, the first and second edges 12, 14 may be shorter in length that the third and fourth edges 16, 18. Further, the first plurality of puncture surface features 80 may have a different configuration than the second plurality of puncture surface features 90, and the various embodiments of the plurality of puncture surface features 80, 90 may include a combination of surface elements. The combination may be optimized for traction, friction, tactile sensitivity and flexibility to improve processing through a printer or scanner device, ease of handling the sheets by the user, and visual aesthetics. Further, the plurality of puncture surface features 80, 90 may be a zone of increased flexibility imparted by coating or embossing to improve printer processing. Printing processing issues may be improved to reduce the skewing of printed indicia during printing through a printer device and reduce the occurrence of having multiple sheets fed through the printer at once, leading to jam.

As such, known label sheet assemblies may have experienced difficulty being fed through printers thereby causing indicia to be applied "off-register" or out of alignment with the intended position along the indicia receiving portions of the labels 60. This off-registration may be due, in part, to the level of friction between a leading edge of the label sheet and the receiving area of the printer device.

In one embodiment, the plurality of puncture surface features 80, 90 are added to improve the way in which label sheet assemblies 10 are fed through printers to receive indicia on the labels 60. The first and second plurality of puncture surface features 80, 90 may be provided to improve the accuracy of indicia application while undergoing stresses caused by processing the label sheet assembly 10 though the printer. The first and second plurality of puncture surface features 80, 90 may have various orientations that improve frictional abutment with the printer. Additionally, the plurality of puncture surface features 80, 90 are flexible enough to allow the printer device to individually index the label sheet assemblies 10 as they are positioned in a stacked orientation relative to one another and being processed by the printer.

Figure 9B:
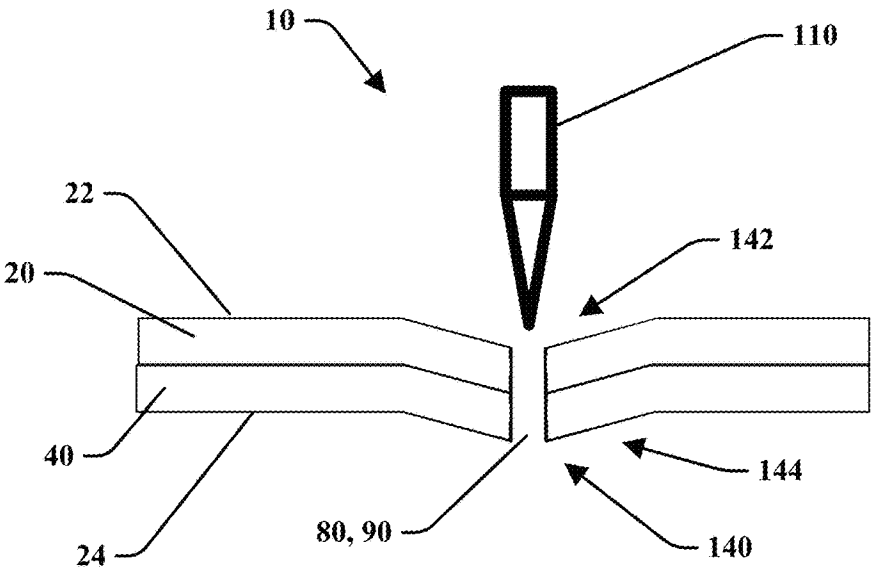
FIG. 9B is an enlarged cross-sectional schematic view of a portion of the label sheet assembly illustrating a puncture surface feature and a method of forming the puncture surface feature according to the present disclosure.
Figure 9A:
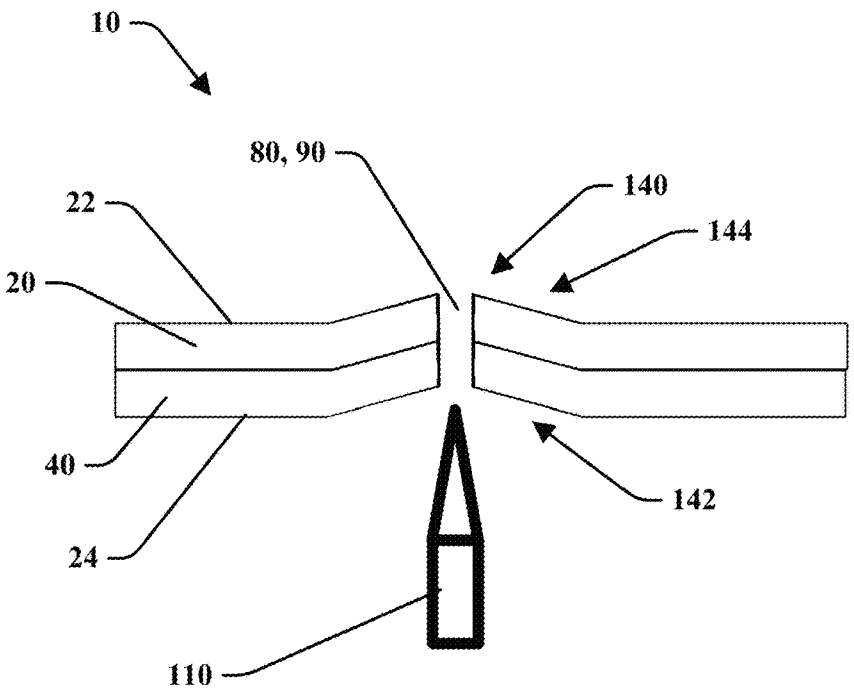
FIG. 9A is an enlarged cross-sectional schematic view of a portion of the label sheet assembly illustrating a puncture surface feature and a method of forming the puncture surface feature according to the present disclosure.

The plurality of puncture surface features 80, 90 may include a plurality of puncture holes formed into a pattern 100A, 100B. FIGS. 9A and 9B illustrate that the puncture holes may be formed with a puncture tool 110 that includes at least one elongated rigid member with a piercing edge configured to pierce through and withdraw from the facestock layer 20 and the liner layer 40 in a desired pattern. The puncture tool 110 may include a plurality of die pins having piercing edges, or just a single die pin edge configured to extend through and withdraw a plurality of times to form the particular pattern 100. The puncture holes include a perimeter that includes a surface feature effect 140 relative to the remaining top surface 22 of the facestock layer 20 or bottom surface 24 of the liner sheet layer 40. The surface feature effect 140 of the perimeter of the puncture holes 80, 90 may include a slightly concave shape 142 along one side, along with a slightly convex shape 144 along the opposite side. The surface feature effect 140 may be considered a textured edge along the header portion 120 or the feeder portion 130 of the label sheet assembly that improves printer feedability through a printer device to print indicia on the labels 60.

Figure 10:
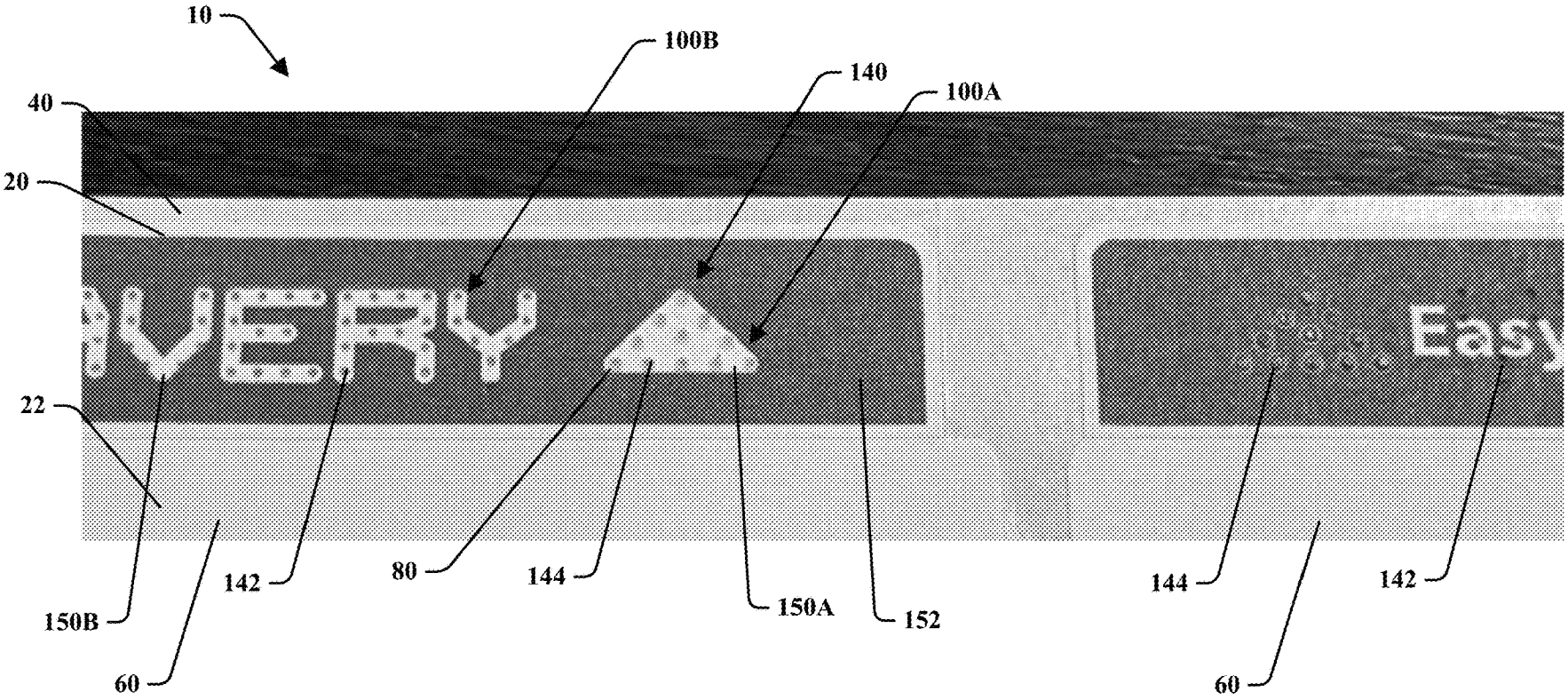
FIG. 10 is a front view of an image of an embodiment of the label sheet assembly illustrating a plurality of patterns and a plurality of puncture surface features according to the present disclosure.

FIG. 10 is an illustration of an embodiment of the label sheet assembly 10 that includes a plurality of puncture surface features 80 along the header portion 120 within the matrix portion 70 of the facestock layer 20. The first row of labels 60 includes a matrix portion 70 having a plurality of puncture surface features 80 formed in a first pattern 100A (in the shape of a triangle or arrow) and a plurality of puncture surface features 80 formed in a second pattern 100B (in the shape of the font "AVERY"). Here, it was found desirable to form the first pattern 100A with puncture holes formed by the die pin 110 through the bottom side 24 (FIG. 9A) to form the slightly convex shape 144 along the top surface 22 for each of the plurality of puncture surface features 80 of the first pattern 100A. Also, the second pattern 100B is formed by puncture holes formed by the die pin 110 through the top side 22 (FIG. 9B) to form the slightly concave shape 142 along the top surface 22 for each of the plurality of puncture surface features 80 formed in the second pattern 100B.

Notably, in an embodiment, the first pattern 100A and the second pattern 100B may include a surrounding or outline pattern 150A, 150B having a color that is in registry with the plurality of puncture surface features 80 of the first pattern 100A or second pattern 100B. The outline pattern 150A, 150B may include a color or indicia that are generally contrasted with the remaining color or indicia along the remaining surface of the facestock layer 20 or liner layer 40 that is not a part of said pattern 100A, 100B. The resulting combination of the puncture surface features 80, along with the surrounding pattern 150A, 150B in registry, has been found to provide desirable visual and textural assistance to a user that allows the user to easily visualize the type of label sheet assembly 10 and an intended direction of printing processing through a printer device. The texture assists to increase friction with pick-up rollers on consumer printers or scanners that can sometimes have trouble properly processing label sheets and feeding them through the printer device while also receiving printed indicia on the labels 60. As can be further seen from FIG. 10, the first pattern 100A and second pattern 100B are provided along a portion of the header portion 120 in alignment with a second row of labels 60. Here, the patterns 100A, 100B do not include the outline patterns 150.

The puncture surface features 80, 90 of the instant application have been found to provide a benefit over the surface features of existing label sheet assemblies, as they do not require the additional step of adding a layer of material, and provide the benefit of reducing material and manufacturing costs while also having the ability to provide slightly convex and slightly concave features along a pattern or shape along either side of the label sheet assembly to assist with processing multiple label sheets through a printer device reducing "off-registration."

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The features of each embodiment described and shown herein may be combined with the features of the other embodiments described herein. The claims as follows are intended to include all modifications and alterations insofar as they come within the scope of the claims or the equivalent thereof

What is claimed is:

1. A label sheet assembly comprising:

a facestock layer having first and second sides, the facestock layer including at least one cut line that defines at least one label and a matrix portion on the first side wherein the facestock layer is configured to receive indicia thereon;

an adhesive layer along the second side;

a liner sheet layer having top and bottom surfaces, the top surface attached to the adhesive layer along the facestock layer; and at least one puncture surface feature along the matrix portion of the facestock layer, wherein the at least one puncture surface feature includes a puncture hole that forms a slightly concave shape along one side and a slightly convex shape along the opposite side, and wherein the at least one puncture surface feature provides a zone of tactile sensitivity along the label sheet assembly and is configured to reduce off-registration of printed indicia along the at least one label when processed through a printer device.

2. The label sheet assembly according to claim 1, further comprising a plurality of puncture surface features applied along a header portion of the first side of the facestock layer wherein the plurality of puncture surface features are formed into a first pattern.

3. The label sheet assembly according to claim 2, further comprising a plurality of puncture surface features applied along a header portion of the first side of the facestock layer wherein the plurality of puncture surface features are formed into a second pattern.

4. The label sheet assembly according to claim 3, wherein the plurality of puncture surface features that form the second pattern include an outline pattern having a color that is in registry with the plurality of puncture surface features of the second pattern.

5. The label sheet assembly according to claim 4, wherein the outline pattern includes a color or indicia that is generally contrasted with the remaining color or indicia along the surface of the facestock layer that is not in registry with said outline pattern.

6. The label sheet assembly according to claim 3, wherein the plurality of puncture surface features that form the first pattern form a slightly concave shape along the top surface and the plurality of puncture surface features that form the second pattern form a slightly concave shape along the top surface.

7. The label sheet assembly according to claim 2, further comprising a plurality of puncture surface features applied along a footer portion opposite from the header portion.

8. The label sheet assembly according to claim 2, wherein the plurality of puncture surface features that form the first pattern include an outline pattern having a color that is in registry with the plurality of puncture surface features of the first pattern.

9. The label sheet assembly according to claim 8, wherein the outline pattern includes a color or indicia that is generally contrasted with a remaining color or indicia along the surface of the facestock layer that is not in registry with said outline pattern.

10. The label sheet assembly according to claim 1, wherein the header portion and the footer portion include a color that is different from the at least one label of the facestock layer.

11. A method of making a label sheet assembly comprising:

providing a facestock layer having first and second sides, the facestock layer including at least one cut line that defines at least one label and a matrix portion on the first side wherein the facestock layer is configured to receive indicia thereon;

providing an adhesive layer along the second side;

providing a liner sheet layer having top and bottom surfaces, the top surface attached to the adhesive layer along the facestock layer; and forming a plurality of puncture surface features along the matrix portion of the facestock layer with a puncture tool having a piercing edge, wherein the plurality of puncture surface features each include a puncture hole that forms a slightly concave shape along one side and a slightly convex shape along the opposite side, and wherein the plurality of puncture surface features provide a zone of tactile sensitivity along the label sheet assembly and are configured to reduce off-registration of printed indicia along the at least one label when processed through a printer device.

12. The method of making a label sheet assembly according to claim 11, further comprises positioning the plurality of puncture surface features along a header portion of the first side of the facestock layer into a first pattern.

13. The method of making a label sheet assembly according to claim 12, further comprises forming a plurality of puncture surface features into a second pattern that is different from the first pattern, and positioning the second pattern along the header portion of the first side of the facestock layer.

14. The method of making a label sheet assembly according to claim 13, further comprises forming an outline pattern having a color that is in registry with the plurality of puncture surface features of the second pattern.

15. The method of making a label sheet assembly according to claim 14, further comprises providing the outline pattern with a color or indicia that is generally contrasted with a remaining color or indicia along the surface of the facestock layer that is not in registry with said outline pattern.

16. The method of making a label sheet assembly according to claim 13, further comprises forming the plurality of puncture surface features of the first pattern with a slightly concave shape along the top surface and forming the plurality of puncture surface features of the second pattern with a slightly concave shape along the top surface.

17. The method of making a label sheet assembly according to claim 11, further comprises applying a plurality of puncture surface features along a footer portion opposite from the header portion.

18. The method of making a label sheet assembly according to claim 11, further comprises forming an outline pattern having a color that is in registry with the plurality of puncture surface features of the first pattern.

19. The method of making a label sheet assembly according to claim 18, further comprises providing the outline pattern with a color or indicia that is generally contrasted with a remaining color or indicia along the surface of the facestock layer that is not in registry with said outline pattern.

20. The method of making a label sheet assembly according to claim 11, further comprises forming the plurality of puncture surface features along the matrix portion of the facestock layer with a puncture tool having a plurality of die pins that each have a piercing edge.

* * * * *